United States Patent [19]

Miyamoto

[11] Patent Number: 4,749,006

[45] Date of Patent: Jun. 7, 1988

[54] AUTOMATIC METHOD AND APPARATUS FOR REMOVING A FAULTY WEFT ON A LOOM

[75] Inventor: Osamu Miyamoto, Kanazawa, Japan

[73] Assignee: Tsudakoma Kogyo Kabushiki Kaisha, Japan

[21] Appl. No.: 758,512

[22] Filed: Jul. 24, 1985

[30] Foreign Application Priority Data

Jul. 26, 1984 [JP] Japan ..... 59-156097
Aug. 15, 1984 [JP] Japan ..... 59-170757

[51] Int. Cl.[4] ..... D03D 49/00; D03D 51/00

[52] U.S. Cl. ..... 139/1 R; 139/1 E; 139/370.2

[58] Field of Search ..... 139/1 R, 116, 429, 435, 139/1 E, 370.2

[56] References Cited

U.S. PATENT DOCUMENTS 3,805,850 4/1974 Van Duynhoven et al. ..... 139/435
4,146,061 3/1979 Gotoh ..... 139/435
4,448,223 5/1984 Deborde et al. ..... 139/435
4,502,512 3/1985 Suzuki et al. ..... 139/435
4,503,889 3/1985 Van Mulleram ..... 139/1 E
4,520,849 6/1985 Suzuki et al. ..... 139/435
4,529,010 7/1985 Aarts ..... 139/429

FOREIGN PATENT DOCUMENTS 0083748 7/1983 European Pat. Off. ..... 139/429
0216956 12/1984 Japan ..... 139/1 E

*Primary Examiner*—Harvey C. Hornsby
*Assistant Examiner*—Joseph S. Machuga
*Attorney, Agent, or Firm*—Lerner, David, Littenberg, Krumholz & Mentlik

[57] ABSTRACT

In a system for removing a faulty weft on a loom a mobile weft catcher unit engageable with a weft of an open shed is driven for successive removal of the next and faulty wefts by operation of a controller which generates phased instruction signals in response to detection of abnormal weft insertion.

15 Claims, 7 Drawing Sheets

AUTOMATIC METHOD AND APPARATUS FOR REMOVING A FAULTY WEFT ON A LOOM

BACKGROUND OF THE INVENTION

The present invention relates to a method and apparatus for removing a faulty weft on a loom, and more particularly relates to an improved system for performing removal of faulty weft and its preparatory operations in a fully automatic fashion on a loom.

Here, the term "a faulty weft" refers to a weft inserted in fault such as a short-pick weft, a nose-bent weft, a broken weft and a weft not correctly sensed by a weft feeler mechanism.

The term "next weft" refers to a weft incompletely inserted subsequent to insertion of a faulty weft due to inertia of loom crank rotation.

It is already known and practiced in various ways to remove a faulty weft from its shed in an automatic fashion when loom crank rotation is stopped on detection of abnormal weft insertion. One example is disclosed in Japanese Patent Opening No. Sho. 58-220856. The system of this earlier proposal is provided with a carriage which reciprocates in the weft direction over sheds in the vicinity of the cloth-fell. The carriage carries a releaser unit and a catcher unit for faulty wefts. When loom crank rotation is stopped due to abnormal weft insertion and the loom crank is rotated over almost one cycle opposite to the normal rotation in order to open the shed of a faulty weft, the point of a finger hanging from the releaser unit slides rearwards on the cloth in the warp direction and hooks the faulty weft at the cloth-fell in order to release it from the cloth-fell. Next, the catcher unit descends with its downward bar and a seat on the lower end of the bar receives the faulty weft released from the cloth-fell in order to clamp it in corporation with an adjacent support. Thereafter, as the catcher unit ascends, the clamped faulty weft in loop is partly taken out of the shed, by operation of a pair of rollers, through between warps forming the upper warp sheet. The operation is performed in an automatic fashion well sufficing the demand for automatization.

This system, however, is accompanied with several drawbacks. First, this system is involved in operations only which follow after the shed for the faulty weft is opened. In other words, the device is not involved in handling of the next weft at all. Automatic removal of the next weft may be completed by repeating twice the operations of the releaser and catcher units. Even when such a repeated operation is employed, the system is accompanied with further drawbacks. During loom crank rotation due to inertia the faulty weft is strongly beated against the cloth-fell by the reed and, as a consequence, is placed in tight contact with the cloth-fell even after its shed is opened. Therefore, it does not always reliably follow that the point of the finger falls between the faulty weft and the cloth-fell on arrival at the cloth-fell. That is, the faulty weft cannot be always reliably hooked by the finger. In order to avoid this failure, the point of the finger may be strongly urged downwards by suitable elastic means such as a spring. Then the finger may damage the clock inasmuch as the sharp point of the finger strongly scratches the cloth surface as it slides.

Even when the faulty weft is successfully released from the cloth-fell, the faulty weft has to be assigned to the seat of the catcher unit bar and clamped in corporation with the adjacent support. Since the faulty weft assumes a quite unstable position after release from the cloth-fell, it is highly difficult to successfully assign such as unstable faulty weft between such small cooperating members over twice. Even a small disturbance on the faulty weft during assignment would cause the faulty weft to fall from the members.

Thus, the system of the earlier proposal is directed to removal of a faulty weft only and preparatory operations such as removal of the next weft have to be carried out by a separate system or systems. In addition, its operation is quite unreliable. In order to raise the operational reliability, one must sacrifice other features such as cloth quality and small construction.

SUMMARY OF THE INVENTION

It is the object of the present invention to enable fully automatic removal of a faulty weft and its preparatory operations in succession on a single apparatus with simplified operation.

The system in accordance with the present invention is provided with a mobile weft catcher arranged near the cutter of the loom. In response to detection of abormal weft insertion, the cutter is provisionally disenabled and clamper on the upstream side of the main nozzle is opened. In response to the detection, the weft catcher unit is brought into engagement with the next weft and activated to fully take the next weft out of its open shed. The shed for the faulty weft is opened by reverse loom crank rotation and the weft catcher unit is again activated to fully take the faulty weft out of its open shed. A weft extending between the weft catcher unit and the main nozzle is cut by the weft cutter by restart of loom crank rotation.

In one preferred embodiment, the weft catcher includes needles adapted for catching wefts to be removed. In another preferred embodiment, the weft catcher includes a roller-suction pipe combination adapted for catching wefts to be removed.

DESCRIPTION OF THE PREFERRED EMBODIMENTS

Figure 1:
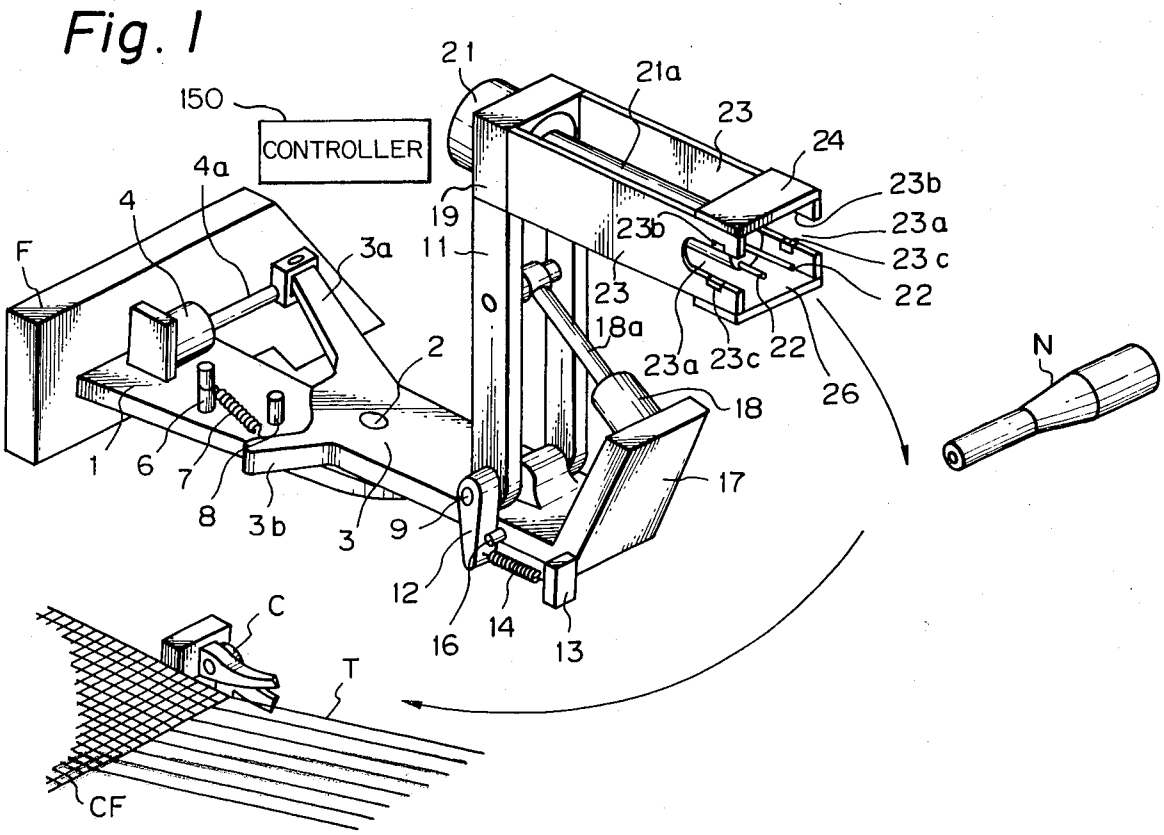
FIG. 1 is a perspective view of one embodiment of the apparatus in accordance with the present invention.

In the drawings, parts substantially common in construction and operation to different embodiments are indicated with common reference symbols.

The first embodiment of the apparatus in accordance with the present invention is shown in FIG. 1 in which the apparatus as a whole is arranged between the cloth and a main nozzle N near the cloth-fell CF on the ejection side of weft. In the case of this embodiment, the weft catcher unit includes a number of needles adapted for catching wefts to be removed.

A base bracket 1 horizontally secured to the framework F of the loom carries, near its free end, an unpright shaft 2 to which the proximal end of a horizontally extending lever bracket 3 is pivoted. The base bracket 1 extends substantially in the warp direction. The proximal end of this lever bracket 3 is provided with a pair of branches 3*a* and 3*b*. The end of the one branch 3*a* is pivotally connected to the end of the plunger 4*a* of the first solenoid 4 horizontally secured to the framework F and extending substantially in the weft direction. The end of the other branch 3*b* is connected to an upright pin 6 on the base bracket 1 by a tension spring 7. As the solenoid 4 is activated to extend or retract its plunger 4*a*, the lever 3 turns horizontally about the shaft 2. In order to limit excessive clockwise (in the drawing) turning of the lever 3, the firt stopper 8 is arranged on the base plate 1 at a position contactable with the branch 3*b* of the lever bracket 3.

Near the free end, the lever bracket 3 carries a transverse horizontal shaft 9 to which a motor lever 11 is pivoted at the lower end. One end of the horizontal shaft 9 extends beyond the edge of the lever bracket 3 and a downward lever 12 formed in one body with the motor lever 11 is pivoted to this extended end of the horizontal shaft 9. The lower end of the downward lever 12 is connected, via a tension spring 14, to a spring seat 13 attached to the side face of the free end of the lever bracket 3. Near the spring seat 13, the second stopper 16 is secured to the side face so that it should come in contact with the downward lever 12 when the motor lever 11 assumes the upright position shown in FIG. 1.

A slant stand 17 is formed at the free end of the lever bracket 3 whilst extending upwards. The second solenoid 18 is secured at its bottom to this slant stand and at the end of its planger 18*a* is pivotally coupled to the body of the motor lever 11. As the solenoid 18 is activated to extend or retract its plunger 18*a*, the motor lever 11 as a whole turns vertically about the horizontal shaft 9.

A bracket 19 secured to the top end of the motor lever 11 carries a motor 21 whose torque of rotation is adjustable. The output shaft 21*a* of this motor 21 extends normal to the motor lever 11 substantially in the warp direction when the apparatus assumes the illustrated position. The free end of the output shaft 21*a* carries a number of projecting needles 22 which are arranged substantially concentrically about a common axis.

Parallel support plates 23 extend so as to sandwich output shaft 21*a* without interfering with the free movement of shaft 21*a*. The position of the free ends of the support plates 23 is roughly the same as that of the needles 22. A pair of boards 24 and 26 are attached to the upper and lower faces of the support plates 23, and the support plates 23 are provided with cutouts 23*a* opening their free ends for introduction of wefts. In the area of the cutouts 23*a* the upper edges of the cutouts 23*a* carry light emitters 23*b* and the lower edges of the cutouts 23*a* carry light receivers 23*c* for detection of a weft connected to its shed.

The relative positions of the above-described parts of the apparatus are designed as follows. When the first solenoid 4 retracts its plunger 4*a* and the second solenoid 18 extends its plunger 18*a*, the lever bracket 3 is placed in alignment with the base plate 1, the motor lever 11 is held almost upright and the needles 22 are placed at their standby position shown in FIG. 1. As the solenoid 18 retracts its plunger 18*a*, the motor lever 11 is tilted and the needles 22 are brought to the first operative position of the main nozzle N. As the first solenoid 4 extends its plunger 4*a*, the lever bracket 3 turns on the base bracket 1 and the needles are brought to the second operative position near the cutter C.

As later described in more detail, the cutter C has to be provisionally disenabled so that a faulty weft should not be cut and could be taken out of the shed in succession to removal of the next weft. One example of the mechanism to this end is shown in FIG. 2, in which a scissors-type cutter is used.

Figure 2:
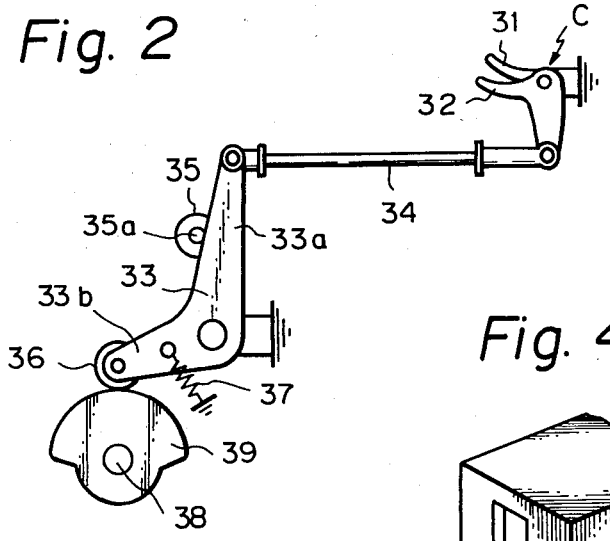
FIG. 2 is a side view of one example of the mechanism for provisionally disenabling a cutter on the apparatus shown in FIG. 1, FIGS. 3A to 3F are simplified top plan views for showing the sequential operation of the apparatus shown in FIG. 1.

In FIG. 2, the cutter C includes a stationary blade 31 secured to the framework of the loom and a movable blade 32 pivoted to the stationary blade 31. A bifurcate cam lever 33 is pivoted at its apex to the framework, and the upper end of its upper branch 33*a* is pivoted to the one end of a link 34 whose the other end is in turn pivoted to the lower end of the movable blade 32 of the cutter C. A cam follower 36 attached to the free end of a lower branch 33*b* of the cam lever 33 is held in resilient rolling contact with a cutter cam 39 by operation of a tension spring 37. The cutter cam 39 is mounted to a cam shaft 38 driven for rotation in synchronism with loom crank rotation. The third solenoid 35 is arranged horizontally near the cam lever 33 so that its plunger 35*a* should engage with the upper branch 33*a* of the cam lever 33 when extended. Upon detection of abnormal weft insertion, the solenoid 35 is activated to extend the plunger 35*a*.

In the case of normal weft insertion, the cam follower 36 rides on the small diametral section of the cutter cam 39 at the moment of cutting, the cam lever 33 turns counterclockwise in the drawing, and the cutter C is closed to cut the weft. Since the plunger 35*a* of the solenoid 35 is held retracted at this moment, the cam lever 33 turns freely as driven by the cutter cam 39. In case of abnormal weft insertion, the solenoid 35 is activated to extend the plunger 35*a*. So, even when the cam follower 36 rides on the small diametral section of the cutter cam 39, the extended plunger 35*a* does not allow free turning of the cam lever 33. As a consequence the cutter C is held open and the faulty weft is not cut.

Other types of mechanisms may be used for provisionally disenabling the weft cutter.

The operation of the apparatus shown in FIG. 1 will now be explained in detail in reference to FIGS. 3A to 3E in which some parts are omitted for simplification purposes.

Figure 3A:
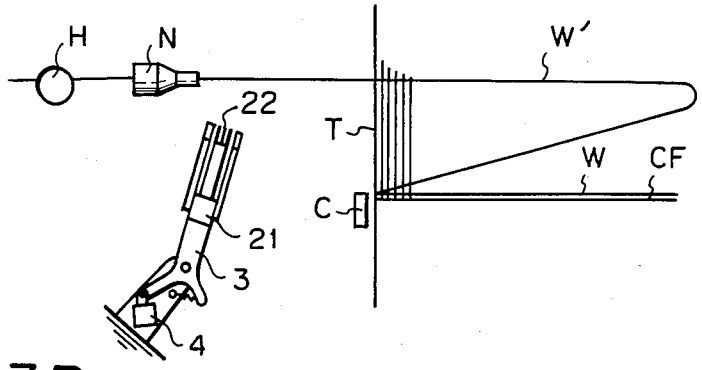

After abnormal weft insertion loom crank rotation continues due to inertia, the shed for a faulty weft W is closed, the next weft W′ is incompletely inserted and loom crank rotation is stopped in the state shown in FIG. 3A. Since the cutter C is provisionally disenabled by a mechanism such as shown in FIG. 2, the faulty weft W is not cut and caught by the warps T in the closed shed. The next weft W' connects on the one hand with the main nozzle N and on the other hand with the faulty weft W and assumes a hairpin shape in its open shed. The needles 22 of the apparatus are yet held at the stand-by position. As this moment, detection of the abnormal weft insertion, more specifically a corresponding detection signal, opens a clamper H on the upstream side of the main nozzle N in order to release the weft connecting with the main nozzle N.

Figure 3B:
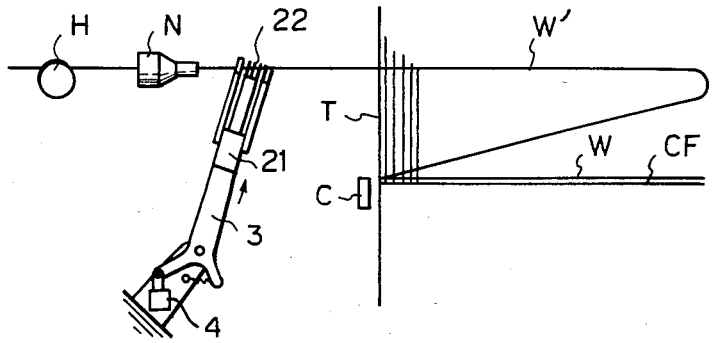

Detection of abnormal weft insertion activates the second solenoid 18 to retract it plunger 18*a*, and the motor lever 11 tilts to bring the needles 22 to the first operative position near the mouth of the main nozzle N as shown in FIG. 3B. In this state the next weft W' passes through the front cutouts 23*a* of the support plate 23 and the needles 22 engage with the next weft W'.

At this moment, detection of the abnormal weft insertion activates the motor 21 so that the needles 22 on its output shaft 21*a* rotate about the common axis in order to wind up the next weft W' around them and take the next weft W' out of the shed.

Figure 3C:
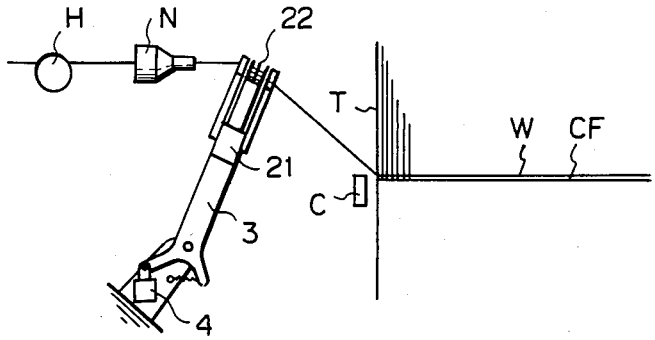

When the next weft W' is fully taken out of the shed as shown in FIG. 3C, the next weft W' wound up around the needles 22 connects directly with the faulty weft W which cannot be taken out as yet due to capture by the warps T of the closed shed. Thus tension is generated in the faulty weft W and proper detection of this tension deactivates the motor 21 in order to stop the rotation of the needles 22.

Figure 3D:
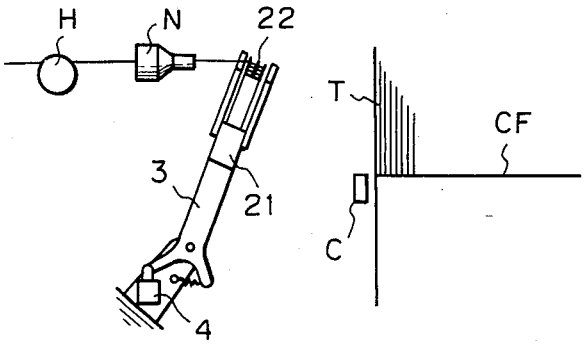
Figure 3E:
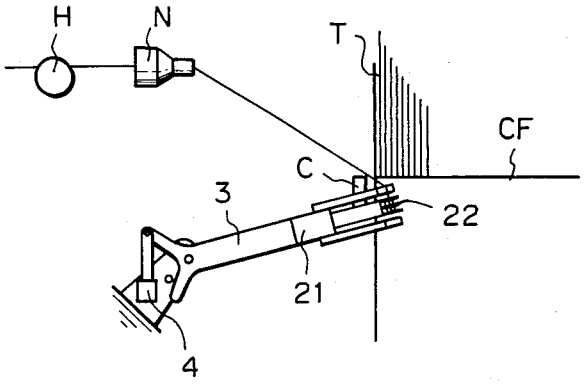

Next, the loom crank is rotated by detection of the abnormal weft insertion over almost one cycle opposite to the normal direction in order to release the faulty weft from capture by the warps T, i.e. to open the shed. Disappearance of the tension in the faulty weft W reactivates the motor 21 so that the needles 22 again rotate about their common axis for winding up the faulty weft W. therearound. As the faulty weft W is fully taken out of the shed and taken up on the needles 22 as shown in FIG. 3D, the detector made up of the light emitters and receivers 23*b* and 23*c* detects absence of the faulty weft W in the cutouts 23*a* and, in response thereto, the motor 21 is deactivated. Concurrently with this, detection of the absence activates the first solenoid 4 to extend its plunger and the lever bracket 3 turns horizontally until its branch 3*b* abuts the first stopper 8 so that the needles 22 should be brought to the second operative position near the cutter as shown in FIG. 3E. During this process the needles 22 hold a weft connecting with the main nozzle N and move whilst taking out the weft out of the main nozzle N. The weft at this moment extends between the main nozzle and the temple whilst passing by the front of the cutter C.

In this state, the clamper H is closed to catch the weft and the motor 21 is rotated a little so that corresponding generation of tension in the weft should deactivate the motor 21. Ths slight rotation of the motor 21 provides the weft with optimum tension. In advance to restart of the loom crank rotation, the loom crank is rotated over one cycle in order to open the shed for the weft normally inserted before the faulty weft W.

Figure 3F:
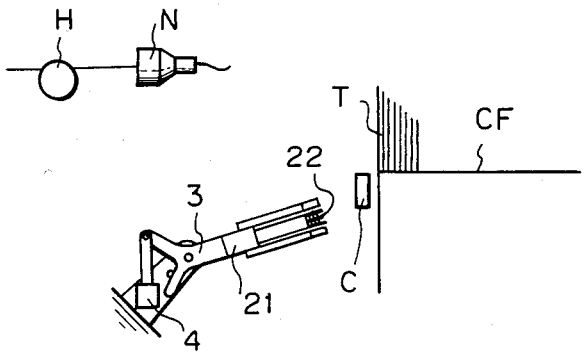

When loom crank rotation is restarted under this condition, the cutter C operates at the next weft insertion and the weft is cut as shown in FIG. 3F. The next and faulty wefts wound up around the needles 22 have no connection with any other wefts.

Removal of the wefts on the needles 22 may be most simply practiced manually. Alternatively, a proper suction tube may be mounted to the bracket 19 on the motor lever 11 with its mouth open facing the needles 22. Such a suction tube may also be arranged at the stand-by or second operative position with its mouth open facing the needles 22 in that position.

Figure 5:
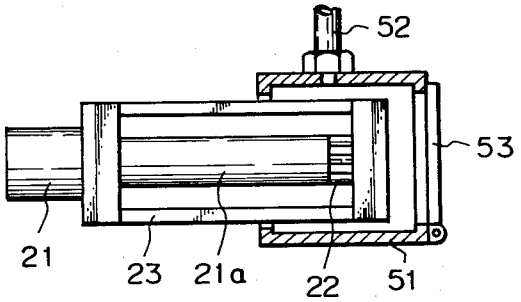
FIG. 5 is a top plan view, partly in section, of one example of the mechanism for removing a faulty weft off the system.

Further, as shown in FIG. 5, a suction box 51 may be arranged at the stand-by position so as to accommodate the needles 22 at that position. The interior of the suction box 51 is connected to a proper source of suction (not shown) via a piping 52. A movable lid 53 is attached to the suction box for smooth passage of the needles 22. Further preferably, the suction box 51 may be provided with means for positively dismounting the wefts from the needles 22.

Finally, the needles 22 resume the initial stand-by position by reversed operation of the solenoids 4 and 18 and the whole apparatus is reset for the next abnormal weft insertion.

In the case of the above-described embodiment, the needles 22 are moved from the first to second operative position by operation of the first solenoid 4 at transit from the state in FIG. 3D to that in FIG. 3E. This is just for the purpose of cutting the weft connecting with the main nozzle N by the weft cutter C. Thus, it is not always necessary to turn the lever bracket 3 horizontally. In the state shown in FIG. 3D, a proper guide may be used for bringing the weft connecting with the main nozzle N into engagement with the front of the cutter C.

The motor 21 is deactivated by detection of tension generated in the weft at the moments of FIGS. 3C and 3E. The weft may be held at a constant tension when detection of torque is employed.

A photoelectric system is used for detection at the moments shown in FIGS. 3D and 3F. From the arrangement of the needles 22 and rotation speed of the motor 21, the amount of the weft to be reserved on the needles 22 per time can be estimated in advance. On the basis of this data, a timer may generate signals at estimated timing for timed activation of related parts.

Figure 4:
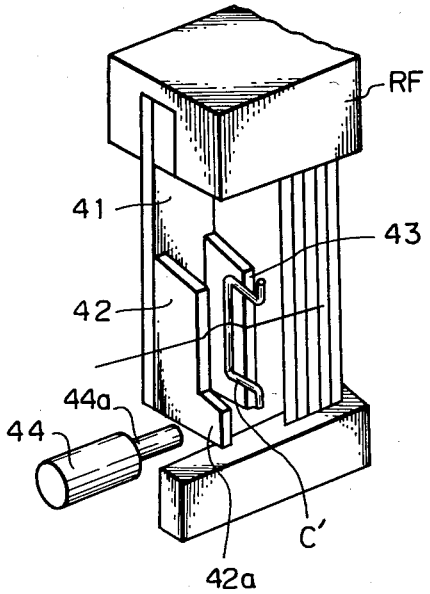
FIG. 4 is a perspective view of another example of the mechanism for provisionally disenabling the cutter.

FIG. 4 depicts one example of the mechanism for provisionally disenabling a cutter when a heat cutter is used. A support plate 41 made of an elastic material is coupled to the reed frame RF on the weft ejection side whilst extending downwards. A pair of mutually spaced weft pressors 42 and 43 are coupled to the front face of the support plate 41 in an arrangement that, at the moment of cutting, they should spacedly sandwich a heat cutter C'. The outer pressor 42 is provided at its lower end with a front projection 42*a* and, on the outer side of the outer pressor 42, a solenoid 44 is arranged horizontally with its plunger 44*a* being directed in the weft direction. This solenoid 44 is activated in response to detection of abnormal weft insertion, more specifically on receipt of a detection signal, to extend its plunger 44*a*. The position of the solenoid 44 is chosen so that, when the reed is at its foremost position, the extended plunger 44*a* of the solenoid 44 should abut against the front face of the projection 42*a* and, as a consequence, the support plate 41 should not follow the forward movement of the reed by being flexed rearwards.

In the case of normal weft insertion, the plunger 44*a* is retracted due to no activation of the solenoid 44. Thus the support plate 41 advances without any flection and the pressors 42 and 43 move forward beyond the position of the heat cutter C' when the reed is at its foremost position. The weft is therefore pressed against the heat cutter C' for cutting as shown in the drawing.

In the case of abnormal weft detection, the solenoid 44 is activated in response to detection in order to extend its plunger 44*a*. As the reed moves forward, the projection 42*a* abuts against the extended plunger 44*a* and the support plate 41 is greatly flexed rearwards due to its elastic nature. As a consequence, the pressors 42 and 43 are located rearwards the heat cutter C' even when the reed is at the foremost position so that the weft should not be pressed against the heat cutter C'. No cutting of the weft results.

In accordance with the present invention, not only removal of a faulty weft but also its associated preparation is performed in succession on a single apparatus for fully automatic, simple and swift removal of faulty weft. The operation is quite reliable because wefts are caught and reserved on needles at a position quite close to the mouth of the main nozzle. Since any parts of the apparatus touch the cloth, no damage is developed on the cloth at all.

Figure 6:
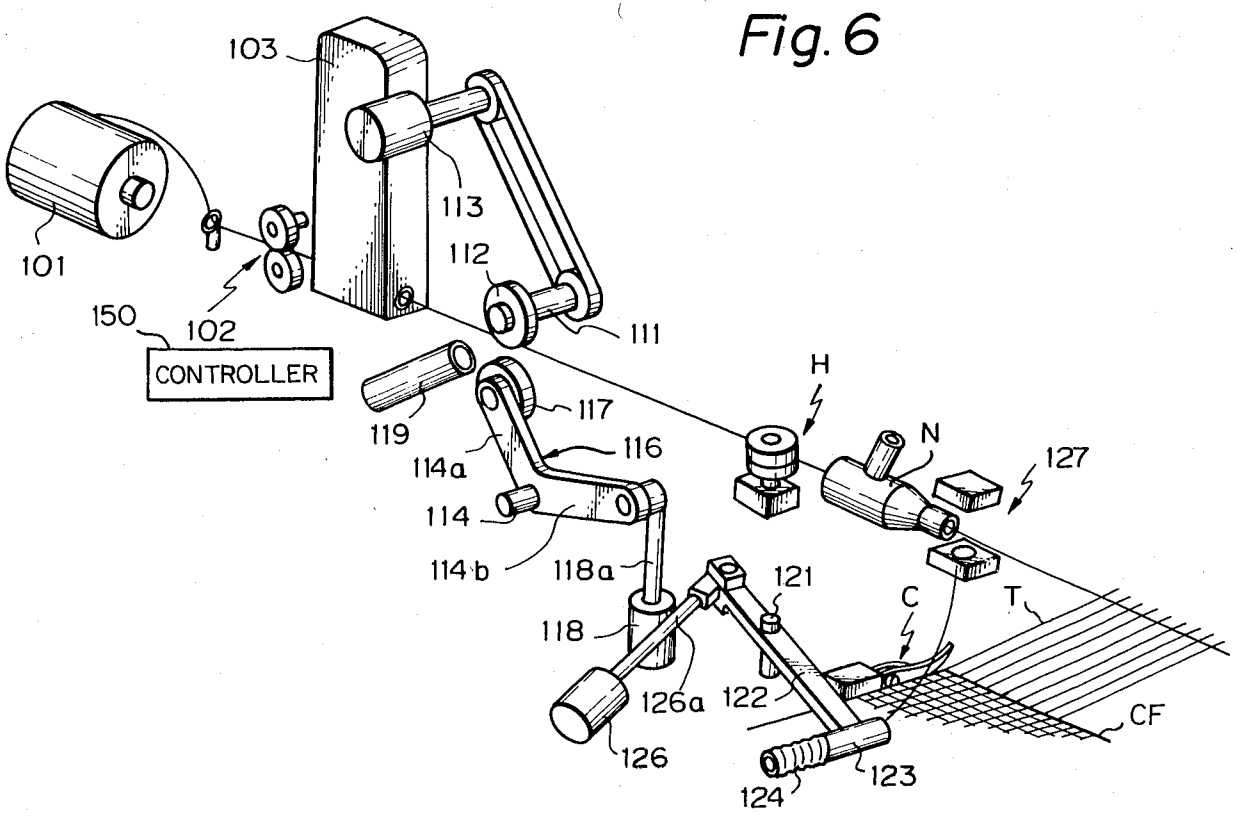
FIG. 6 is a perspective view of another embodiment of the apparatus in accordance with the present invention.

Another embodiment of the apparatus in accordance with the present invention is shown in FIG. 6, in which the weft catcher unit includes a roller suction tube combination. A weft is delivered from a supply source 101 by a pair of delivery rollers 102 and, after reservation in a weft reservoir 103, led to a main nozzle N via a clamper H. At the moment of weft insertion, the weft is inserted into an open shed by fluid ejection of the main nozzle N and cut by a cutter C.

A horizontal shaft 111 is coupled, via a proper bearing, to the framework (not shown) of the loom between the reservoir 103 and the clamper H above the path of travel of the weft and an upper reverse roller 112 is securedly mounted to the horizontal shaft 111. The horizontal shaft 111 is operationally coupled to the output shaft of a torque motor 113, which is securedly mounted to the framework, via a pulley-belt transmission. A horizontal pin 114 is secured to the framework whilst extending in the axial direction of the horizontal shaft 111 and a bifurcate lever 116 is pivoted at its apex to this pin 114. A lower reverse roller 117 is rotatably coupled to the top end of an upper branch 114*a* of the lever 116 in an arrangement engageable with the upper reverse roller 112. The lower end of the lower branch 114*b* of the lever 116 is pivotally coupled to the upper end of the plunger 118*a* of the first solenoid 118 vertically secured to the framework. As the first solenoid 118 is activated to extend its plunger 118*a*, the lower reverse roller 117 is held separate from the upper reverse roller 112 as shown in FIG. 6. Whereas, as the first solenoid 118 is activated to retract its plunger 118*a*, the lower reverse roller 117 is brought into engagement with the upper reverse roller 112. The reverse rollers 112 and 117 are located somewhat upstream of the clamper H in an arrangement to nip a weft when they are in engagement. The first suction tube 119 is provided with its mouth closely facing the nip point of the reverse rollers 112 and 117. The first suction tube 119 is connected to a proper source of suction (not shown).

A vertical pin 121 is secured to the framework near the cutter C and a lever 122 is substantially horizontally pivoted at its body to this pin 121. The second suction tube 123 is coupled to one end of the lever 122 and connected to a proper source of suction (not shown) via a flexible hose 124 which allows free displacement of the suction tube 123. The other end of the lever 122 is pivotally coupled to the end of the plunger 126*a* of the second solenoid 126 horizontally secured to the framework. As the second solenoid 126 is activated to extend its plunger 126*a*, the second suction tube 123 is held at the stand-by position shown in the drawing. Whereas, as the second solenoid 126 is activated to retract its plunger 126*a*, the second suction tube is moved to the operative position near the mouth of the main nozzle N. A photoelectric weft detector 127 is arranged just in front of the mouth of the main nozzle N. The weft detector 127 is made up of a light emitter and light receiver both facing the path of travel of weft.

Figure 8:
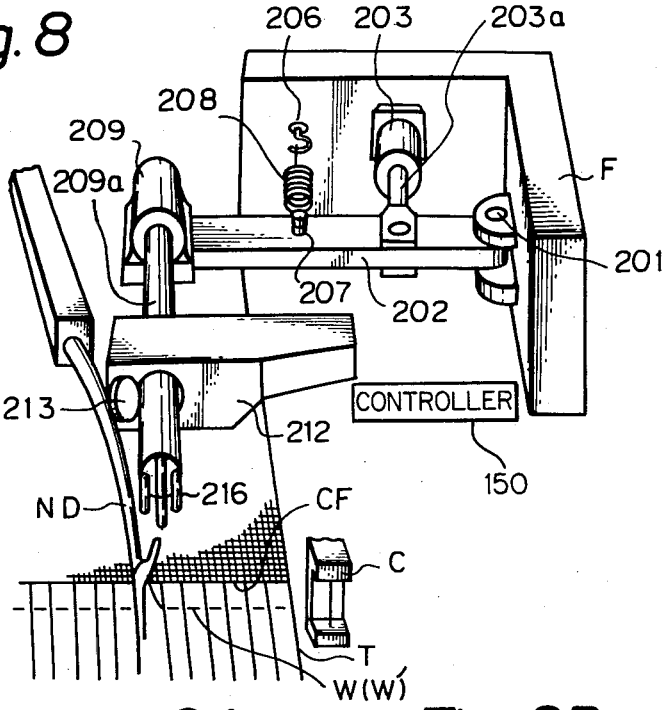
FIG. 8 is a perspective view of the other embodiment of the apparatus in accordance with the present invention.

The above-described parts of the apparatus perform phased operations in sequence in response to detection of abnormal weft insertion. To this end, the apparatus is further provided with a controllable 150 (See FIG. 6) which includes proper timers and delay circuits which controller is shown in FIGS. 1, 6 and 8 with respect to the disclosed embodiments.

Figure 7A:
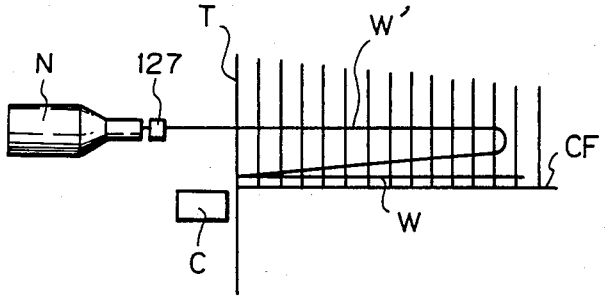
FIGS. 7A to 7C are simplified top plan views for showing the sequential operation of the apparatus shown in FIG. 6.
Figure 7B:
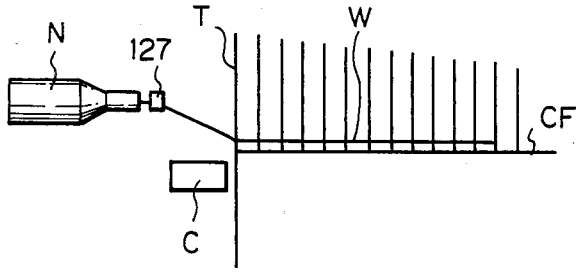
Figure 7C:
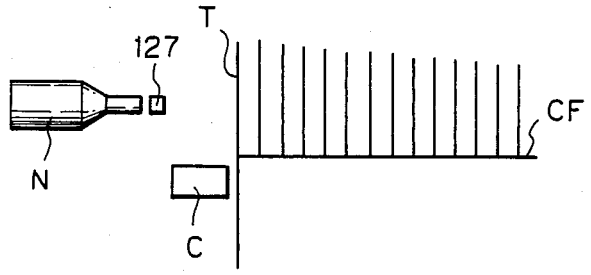

The operation of the apparatus of the above-described construction will now be explained in sequence in reference to FIGS. 7A to 7C.

As in the foregoing embodiment, the weft cutter C is automatically and provisionally disenabled in response to detection of abnormal weft insertion, and the clamper H is opened. The next weft W' connecting with the main nozzle N assumes a hairpin shape in the open shed as shown in FIG. 7A.

Thereafter, the first solenoid 118 is activated in response to detection of abnormal weft insertion to retract its plunger 118*a*, and, as a consequence, the lower reverse roller 117 is brought into engagement with the upper reverse roller 112, thereby nipping the weft therebetween. In this state, the torque motor 113 is activated so that the reverse rollers 112 and 117 pull the weft from the main nozzle N. The pulled weft is instantly collected by the first suction tube 119. As a consequence, the hairpin shaped next weft W' is continuously taken out of the open shed and collected in the first suction tube 119. Finally, the next weft W' is fully taken out of the open shed as shown in FIG. 7B. Since the faulty weft W is caught by warps T of the closed shed, tension is generated in the weft nipped by the reverse rollers 112 and 117. On detection of this tension, the torque motor 113 is deactivated to stop rotation of the reverse rollers 112 and 117. A usual feed-back control system may be used for this purpose.

About this moment, the loom crank is rotated over almost one cycle opposite to the normal direction in order to open the shed for the faulty weft W. The tension in the weft disappearas due to relesae of the faulty weft W and the torque motor 113 is again activated to rotate the reverse rollers 112 and 117. Rotation of the reverse rollers 112 and 117 takes the faulty weft W from its open shed and, finally, the faulty weft W is fully taken out of the open shed as shown in FIG. 7C. As the end of the faulty weft W is going to disappear in the main nozzle N, the weft detector 127 detects this disappearance and, thereupon, deactivates the torque motor 113 in order to stop rotation of the reverse rollers 112 and 117. Concurrently with this, the weft detector 127 activates the first solenoid 118 to extend its plunger 118*a*. As a result, the reverse rollers 112 and 117 separate from each other in order to release the weft. Suction by the first suction tube 119 is also stopped.

At this moment, the loom crank is further rotated over almost one cycle opposite to the normal direction in order to open the shed for the normal weft preceding the faulty weft W. Next the second solenoid 126 is activated to retract its plunger 126*a*, and the lever 122 turns about the pin 121 in order to bring the second suction tube 123 to the operative position near the mouth of the main nozzle N. In this state, the second suction tube 123 sucks the leading end of the weft in the main nozzle N. Thus, the second suction tube 123 collects the next and faulty wefts previously sucked in the first section tube 119. After complete collection, the second solenoid 126 is again activated to extend its plunger 126*a* thereby returning the second suction tube 123 to the stand-by position shown in FIG. 6.

At this moment, the main nozzle N and the second suction tube 123 are yet connected by a weft. When normal rotation of the loom crank is restarted, the cutter C is enabled in advance to the first weft insertion in order to cut the weft connecting them.

In addition to the merits possessed by the apparatus of the first embodiment, the apparatus of this embodiment has a merit that the next and faulty wefts can be very easily removed out of the system due to combined operation of the suction tubes 119 and 123.

The other embodiment of the apparatus in accordance with the present invention is shown in FIG. 8, in which the weft catcher unit includes one or more needles. The apparatus as a whole is located near and above the cloth-fell CF on the weft ejection side of the loom. A vertical pin 201 is mounted to the framework F of the loom and a horizontal motor lever 202 is pivoted at its proximal end to this pin 201 whilst extending in the weft direction. A solenoid 203 is horizontally secured to the framework F with the end of its plunger 203*a* being pivoted to the body of the motor lever 202. A tension spring 208 connects a spring seat 206 on the framework F and a pin 207 secured to the body of the motor lever 202. As the solenoid 203 is activated to extend or retract its plunger 203*a*, the motor lever 202 turns horizontally about the pin 201.

Figure 9A:
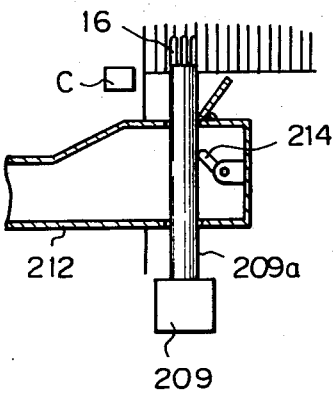
FIGS. 9A and 9B are top plan views, partly in section, for showing the sequential operation of the apparatus shown in FIG. 8.

A motor 209 is secured to the distal end of the motor lever 202 with its output shaft 209*a* being directed horizontally in the warp direction. Near the distal end, the output shaft 209*a* idly passes through a fixed suction box 212. The suction box 212 is provided with a freely openable door 213 on its wall for free passage of the output shaft 209*a*. The door 213 is properly spring biased for automatic closure. As best seen in FIG. 9A, the suction box 212 is further internally provided with a hook 214 is always kept in resilient pressure contact with the body of the output shaft 209*a* by operation of a suitable spring (not shown). The suction box 212 as a whole has a substantially air-tight construction and its interior is connected to a proper source of suction (not shown). The distal end of the output shaft 209*a* holds a number of needles 216 arranged substantially concentrically about the axis of the output shaft 209*a* whilst extending in the warp direction. The total arrangement of the parts are designed so that the needles 216 should be above the cloth-fell at the maximum extension of the output shaft 209*a* and disappear in the suction box 212 at the maximum retraction of the output shaft 209*a*.

As in the foregoing embodiments, phased operations of the above-described are controlled by a proper controller 150 (see FIG. 6) in response to detection of abnormal weft insertion.

Figure 9B:
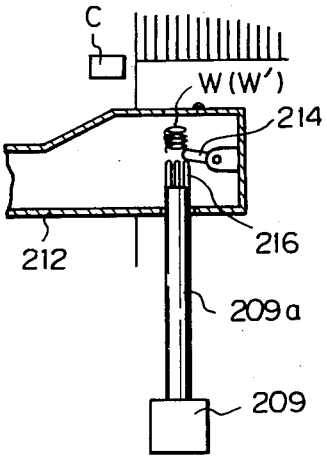

The operation of the apparatus of the above-described contsruction will now be explained in sequence in reference to FIGS. 9A and 9B.

In the initial state of the apparatus, the plunger 203*a* of the solenoid 203 is retracted, the motor lever 202 is swung away from the cloth-fell, the needles 216 disappear in the suction box 212 and the motor 209 remains deactivated.

In the case of this embodiment, the cutter C is not disenabled and operates to cut the next and faulty wefts. The next and faulty wefts are now disconnected from the main nozzle. Loom crank rotation is automatically stopped in response to detection of abnormal weft insertion.

Thereafter, the solenoid 203 is activated to extend its plunger 203*a*, the motor lever 202 turns towards the cloth-fell CF and the needles 216 appear from the suction box 212 jostling the door 213 in order to be registered at the operative position of the warps T near the cloth-fell CF. Concurrently with this process, a hook needle ND cooperative with the apparatus of the present invention gets into the open shed, hooks the next weft W' in the shed and gets out of the shed in order to partly take the next weft W' out of its shed and bring same into engagement with the needles 216 registered at the operative position.

Upon such an engagement, the motor 209 is activated to rotate the needles 216 about their common axis. Since the next weft W' remains free in the open shed being disconnected from the main nozzle N, the next weft W' is wound about the needles 216 and fully taken out of its shed.

Then the motor 209 is deactivated by operation of a proper timer and the solenoid 203 is activated to retract its plunger 203*a*. The motor lever 202 turns a little away from the cloth-fell CF. At this moment the faulty weft W is still caught by warps T of closed shed and not ready for removal, the loom crank is rotated over almost one cycle opposite to the normal direction in order to open the shed for the faulty weft W.

Then, the solenoid 203 is activated to extend its plunger 203*a*, the motor lever 202 turns towards the cloth-fell CF and the needles 216 are again registered at the operative position of the warps T near the cloth-fell CF. Concurrently with this, the hook needle ND again gets into the open shed, hooks the faulty weft W in the shed and gets out of the shed in order to partly take the faulty weft out of its shed and bring same into engagement with the needles 216 registered at the operative position.

Upon such an engagement, the motor 209 is again activated to rotate the needles 216 about their common axis. Since the faulty weft W remains free in the open shed being disconnected from the main nozzle N, the faulty weft W is wound about the needles 216 on the previously wound next weft W' and fully taken out of its shed.

Then the motor 209 is deactivated by operation of the timer and the solenoid 203 is activated to retract its plunger 203*a*. The motor lever 202 turns away from the cloth-fell CF and the needles 216 disappear into the suction box 212 thereby causing automatic closure of the door 213. Movement of the needles 216 continues until the next and faulty wefts W' and W are scratched off the needles 216 by operation of the hook 214 as shown in FIG. 9B. The looped next and faulty wefts W' and W are removed off the system by operation of the suction. The apparatus finally resumes the initial state.

As a substitute for the plurality of needles 216 used for the above-described embodiment, a single needle having a frictional surface may be attached to the end of the output shaft 209a of the motor 209. A needle with radial surface thorns may be used also.

In the foregoing embodiments, the solenoids may be replaced by other means such as fluid cylinders.

What is claimed is:

1. Automatic method for removing a faulty weft from a cloth-fell having a plurality of warp fibers arranged to provide an open and closed shed for receiving a weft on a loom having a weft cutter, a main nozzle, and a crank, and using a rotary shaft provided at a free end with a plurality of parallel needles arranged concentrically about a common axis comprising the steps of detecting an abnormal weft insertion, temporarily disenabling the weft cutter in response to detection of abnormal weft insertion, releasing a next weft supplied to the main nozzle, engaging said needles with said next weft, rotating said needles about said common axis in response to said detection of abnormal weft insertion until said next weft is fully taken out from its shed wound upon said needles, rotating the loom crank over almost one cycle opposite to a normal direction in order to open the shed for a faulty weft, engaging said needles with said faulty weft, rotating said needles again about said common axis until said faulty weft is fully taken out from its shed wound upon said needles, facing a weft connected to said main nozzle to said weft cutter, restarting loom crank rotation, and cutting said weft by said weft cutter in response to said restart of loom crank rotation.

2. Automatic apparatus for removing a faulty weft from a cloth-fell having a plurality of warp fibers arranged to provide an open and closed shed for receiving a weft on a loom having a weft cutter and a main nozzle comprising means for detecting abnormal weft insertion, means for temporarily disenabling the weft cutter, means for releasing a weft on the upstream side of the main nozzle, a moveable weft catcher unit arranged near said main nozzle and having a rotary shaft provided at its free end with a plurality of needles each having a longitudinal axis arranged parallel to one another and concentrically about a common axis, said needles arranged parallel to said common axis, means for bringing said needles of said weft catcher unit into engagement with a weft whose shed is open, means for rotating said needles about said common axis until said weft is fully taken out of said open shed, and a controller for activating and deactivating said apparatus at phased, programmed moments in response to said means for detecting abnormal weft insertion.

3. Automatic apparatus as claimed in claim 2 further comprising means for detecting absence of a weft extending between said weft catcher unit and said open shed.

4. Automatic apparatus as claimed in claim 2 in which said means for bringing includes base bracket pivoted to the frame of said loom for horizontal turning, a motor lever pivoted to said base bracket for vertical turning, and means for driving said base bracket and said motor lever for said horizontal and vertical turnings on receipt of instruction signals from said controller, said means for driving being held by said motor lever.

5. Automatic apparatus for removing a faulty weft from a cloth-fell of a cloth having a plurality of warp fibers arranged to provide an open and closed shed for receiving a weft on a loom having a frame comprising means for detecting abnormal weft insertion, a moveable weft catcher unit arranged near the cloth-fell at the edge of a cloth and including at least one needle, means for bringing said at least one needle of said weft catcher unit into engagement with a weft which is partially taken out of its open shed, means for rotating said at least one needle of said weft catcher unit until said weft is fully taken out of said open shed, said means for rotating including a motor having an output shaft, said at least one needle coupled to the distal end of said output shaft, said output shaft rotating said at least one needle about one axis parallel to another axis about which said output shaft rotates, said at least one needle arranged parallel to said another axis, means for collecting said weft from said at least one needle of said weft catcher unit, said means for collecting including a suction box through which said output shaft of said motor idly extends, said suction box internally including at least one hook in constant resilient pressure contact with the body of said output shaft of said motor, and a controller for activating and deactivating said apparatus at phased, programmed moments in response to said means for detecting abnormal weft insertion.

6. Automatic apparatus as claimed in claim 5 in which said means for bringing includes a motor lever pivoted to the frame of said loom for horizontal turning and means for driving said motor lever for said horizontal turning on receipt of instruction signals from said controller, and said motor is held by said motor lever.

7. Automatic method for removing a faulty weft from a cloth-fell having a plurality of warp fibers arranged to provide an open and closed shed for receiving a weft on a loom having a weft cutter, a main nozzle, and a crank, and using a pair of reverse rollers in combination with a suction tube comprising the steps of detecting an abnormal weft insertion, temporarily disenabling the weft cutter in response to detection of abnormal weft insertion, releasing a next weft supplied to the main nozzle, nipping said next weft by said reverse rollers on the upstream side of said main nozzle, rotating said reverse rollers in a direction opposite to normal weft supply to said main nozzle, sucking, by said suction tube, said next weft, reversed by said reverse rollers until said next weft is fully taken out from its shed, nipping said faulty weft by said reverse rollers on the upstream side of said main nozzle, rotating the loom crank over almost one cycle opposite to a normal direction in order to open the shed for the faulty weft, rotating said reverse rollers in a direction opposite to normal weft supply to said main nozzle, sucking, by said suction tube, said faulty weft reversed by said reverse rollers until said faulty weft is fully taken out from its shed, facing a weft connected to said main nozzle to said weft cutter, restarting loom crank rotation, and cutting said weft facing said weft cutter by said weft cutter in response to restart of loom crank rotation.

8. Automatic method as claimed in claim 7, further including collecting said next weft and said faulty weft previously sucked in said suction tube.

9. Automatic apparatus for removing a faulty weft from a cloth-fell having a plurality of warp fibers arranged to provide an open and closed shed for receiving a weft on a loom having a weft cutter and a main nozzle comprising means for detecting abnormal weft insertion, means for temporarily disenabling the weft cutter, means for releasing a weft on the upstream side of the main nozzle, a moveable weft catcher unit arranged near said main nozzle, said weft catcher unit including a pair of reverse rollers facing the path of travel of weft on the upstream side of said main nozzle, and a suction tube opening in the vicinity of said reverse rollers, means for bringing said weft catcher unit into engagement with a weft whose shed is open, means for activating said weft catcher unit to fully take said weft out of said open shed, and a controller for activating and deactivating said apparatus at phased, programmed moments in response to detection of abnormal weft insertion.

10. Automatic apparatus as claimed in claim 9 further comprising activating means which includes a torque motor operationally coupled to one of said reverse rollers in order to rotate same opposite to normal weft supply to said main nozzle.

11. Automatic apparatus as claimed in claim 9 in which said means for bringing causes peripheral contact between said reverse rollers in order to nip said weft.

12. Automatic apparatus as claimed in claim 9 further comprising means for collecting said weft from said weft catcher unit.

13. Automatic apparatus as claimed in claim 12 in which said means for collecting includes a suction tube moveable between an operative position near the mouth of said main nozzle and a stand-by position off said main nozzle.

14. Automatic apparatus for removing a faulty weft from a cloth-fell having a plurality of warp fibers arranged to provide an open and closed shed for receiving a weft on a loom having a weft cutter and a main nozzle comprising means for detecting abnormal weft insertion, means for temporarily disenabling the weft cutter, means for releasing a weft on the upstream side of the main nozzle, a moveable weft catcher unit arranged near said main nozzle and having a rotary shaft provided at its free end with a plurality of parallel needles arranged concentrically about a common axis, means for bringing said needles of said weft catcher unit into engagement with a weft whose shed is open, means for rotating said needles about said common axis until said weft is fully taken out of said open shed, a controller for activating and deactivating said apparatus at phased, programmed moments in response to said means for detecting abnormal weft insertion, and a suction box through which said needles idly extend, said suction box being internally provided with at least one hook in constant, resilient pressure contact with said rotary shaft of said moveable weft catcher.

15. Automatic apparatus for removing a faulty weft from a cloth-fell of a cloth having a plurality of warp fibers arranged to provide an open and closed shed for receiving a weft on a loom having a frame comprising means for detecting abnormal weft insertion, a moveable weft catcher unit arranged near the cloth-fell at the edge of a cloth and including at least one needle, means for bringing said at least one needle of said weft catcher unit into engagement with a weft which is partially taken out of its open shed, means for rotating said at least one needle of said weft catcher unit until said weft is fully taken out of said open shed, said means for rotating rotates said at least one needle about one axis parallel to another axis about which said rotating means rotates, said at least one needle arranged parallel to said another axis, means for collecting said weft from said at least one needle of said weft catcher unit, and a controller for activating and deactivating said apparatus at phased, programmed moments in response to said means for detecting abnormal weft insertion.

* * * * *